United States Patent [19]

Weigant

[11] 4,366,649

[45] Jan. 4, 1983

[54] AUTOMATIC GATE

[76] Inventor: Frederick E. Weigant, 4730 E. 23rd St., Tulsa, Okla. 74114

[21] Appl. No.: 269,642

[22] Filed: Jun. 2, 1981

[51] Int. Cl.[3] ..... E05F 11/54

[52] U.S. Cl. ..... 49/362

[58] Field of Search ..... 49/362, 360, 404

[56] References Cited

U.S. PATENT DOCUMENTS

| | | | |
|---|---|---|---|
| 515,672 | 2/1894 | Goode et al. | 49/362 X |
| 1,063,328 | 6/1913 | Christopher | 49/362 X |
| 1,997,175 | 4/1935 | Gussack | 49/362 X |
| 3,257,756 | 6/1966 | Mealer | 49/362 X |
| 4,188,752 | 2/1980 | Monot | 49/362 X |

*Primary Examiner*—Philip C. Kannan

*Attorney, Agent, or Firm*—Head, Johnson & Stevenson

[57] ABSTRACT

An improved electrically operated gate having a rectangular frame with a top horizontal rail, a bottom horizontal rail and vertical ends, a roller adjacent each end extending below the bottom rail by which the gate rolls from open to closed positions, the gate moving in a longitudinal vertical plane, a roller engaging the top rail to maintain the frame in a vertical plane, an inverted horizontal rack affixed to the frame on one side thereof adjacent the frame bottom, the rack having a series of equally spaced teeth, an electric motor drive means affixed at a stationary position adjacent the gate frame and having a pinion drive gear rotatably extending therefrom below the rack and in engagement with the rack teeth, and springs to resiliently urge the pinion gear upwardly into engagement with the rack teeth so that when the electric motor is energized the frame is longitudinally moved to open or close the gate.

8 Claims, 8 Drawing Figures

AUTOMATIC GATE

BACKGROUND OF THE INVENTION

1. Field of the Invention

This invention relates to a gate which can be electrically operated to open and close. The gate is of the type including a longitudinal vertically supported frame and in which the frame moves longitudinally between an open and closed position. The gate is particularly applicable to control access to vehicular traffic.

2. Prior Art

Others have provided automatic gates of types similar to the present invention, and for an indication of the state of the art to which the present invention pertains, reference may be had to the following U.S. Pat. Nos.:

Goode et al. 515,672
Christopher 1,063,328
Gussack 1,997,175
Mealer 3,257,756
Monot 4,188,752

The present invention is directed to improvements over the prior art. Particularly, the gate of this invention is unique compared to the prior art in its simplicity of construction, its economy of design, its dependability and long life. Only readily available structural and mechanical parts are required for the assembling of the gate of the invention, and the fact that the gate can be manufactured without requiring special fittings, castings, or machined parts is one of the features which makes it unique.

SUMMARY OF THE INVENTION

An improved electrically operated gate is provided. The gate is in the form of a rectangular frame having a top horizontal rail, a bottom horizontal rail, and vertical ends. A roller adjacent each end of the frame below the rail bottom provides means for the gate to be moved laterally in a vertical plane from an open to a closed position and vice versa. A roller is affixed to a vertical support post adjacent the vertical frame. The roller engages the top rail to maintain the frame in a vertical plane. To provide means of electrically longitudinally positioning the gate frame, an inverted horizontal rack is affixed to the frame on one side thereof, preferably adjacent the frame bottom. The rack is economically formed utilizing a structural channel member having a horizontal web and opposed downwardly extending integral sides. Cylindrical pins are affixed to the internal surfaces of the opposed sides. The axii of the pins are parallel to each other, and the pins are equally spaced apart. To longitudinally position the gate, a pinion gear is provided to engage the rack. An important feature of the invention is the provision of means to support the pinion gear in such a way that it engages the rack to move the gate longitudinally even though the elevational position of the gate may change such as when the rollers pass over obstructions, dirt, mud, gravel, or whatever which might inadvertently exist in the roller pathways. This is accomplished by a base structure supported adjacent the gate and having hinged to it a support structure. The support structure is upwardly urged by springs which are retained in tubular members affixed to the base. Into the tubular members for engagement with the springs are inserted plungers, and means is provided for adjusting the length of the plungers which are attached at their upper ends to the support structure. Thus the support structure is pivotally supported to the base, and one end thereof is resiliently urged upwardly. Affixed on the support structure is an electric motor and a drive shaft. On one end of the drive shaft is the pinion gear which engages the rack. The other end of the drive shaft includes a drive gear. The motor has a shaft extending from it which has a gear, and the motor gear drives the shaft drive gear by means of a chain. Thus the entire support structure including the motor, shaft, and the pinion gear are resiliently urged upwardly to ensure that the pinion gear securely engages the rack at all times even though the gate frame may be inadvertently raised as it travels from open or closed position due to obstructions in the path of the rollers. The rollers may roll on a flat surface or, in the preferred arrangement, a track is provided on which the rollers roll; and in such instance, the track has a configuration such as an inverted V which conforms to a recess formed in the circumferential peripheral surfaces of the rollers.

DESCRIPTION OF THE VIEWS

DETAILED DESCRIPTION OF A PREFERRED EMBODIMENT

Figure 2:
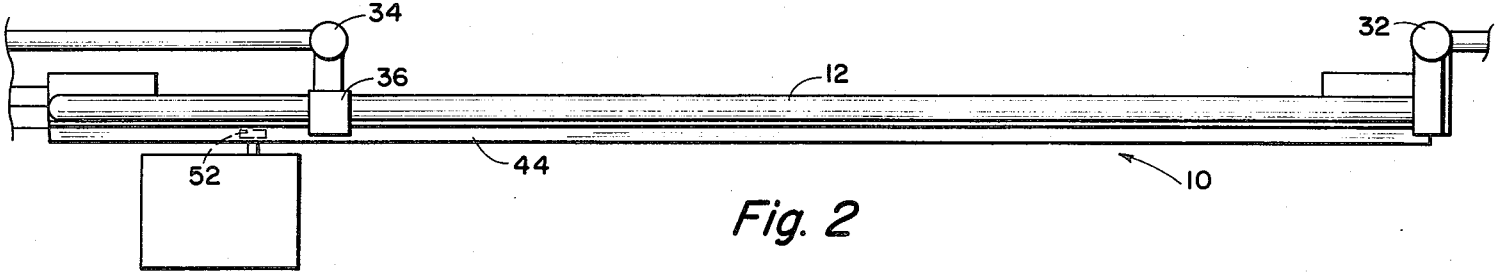
FIG. 2 is a top view of the gate of FIG. 1.
Figure 1:
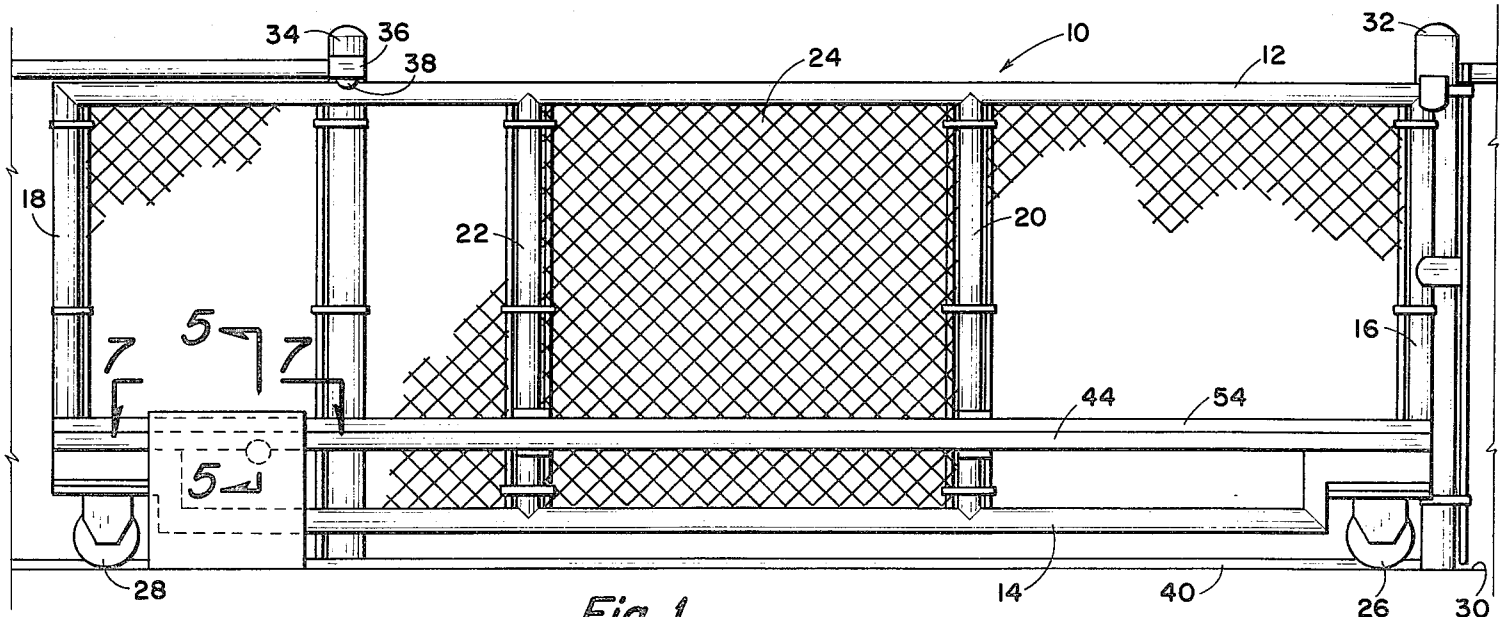
FIG. 1 is an elevational view of a gate employing the preferred embodiment of the invention in which the gate is shown in the closed position.
Figure 3:
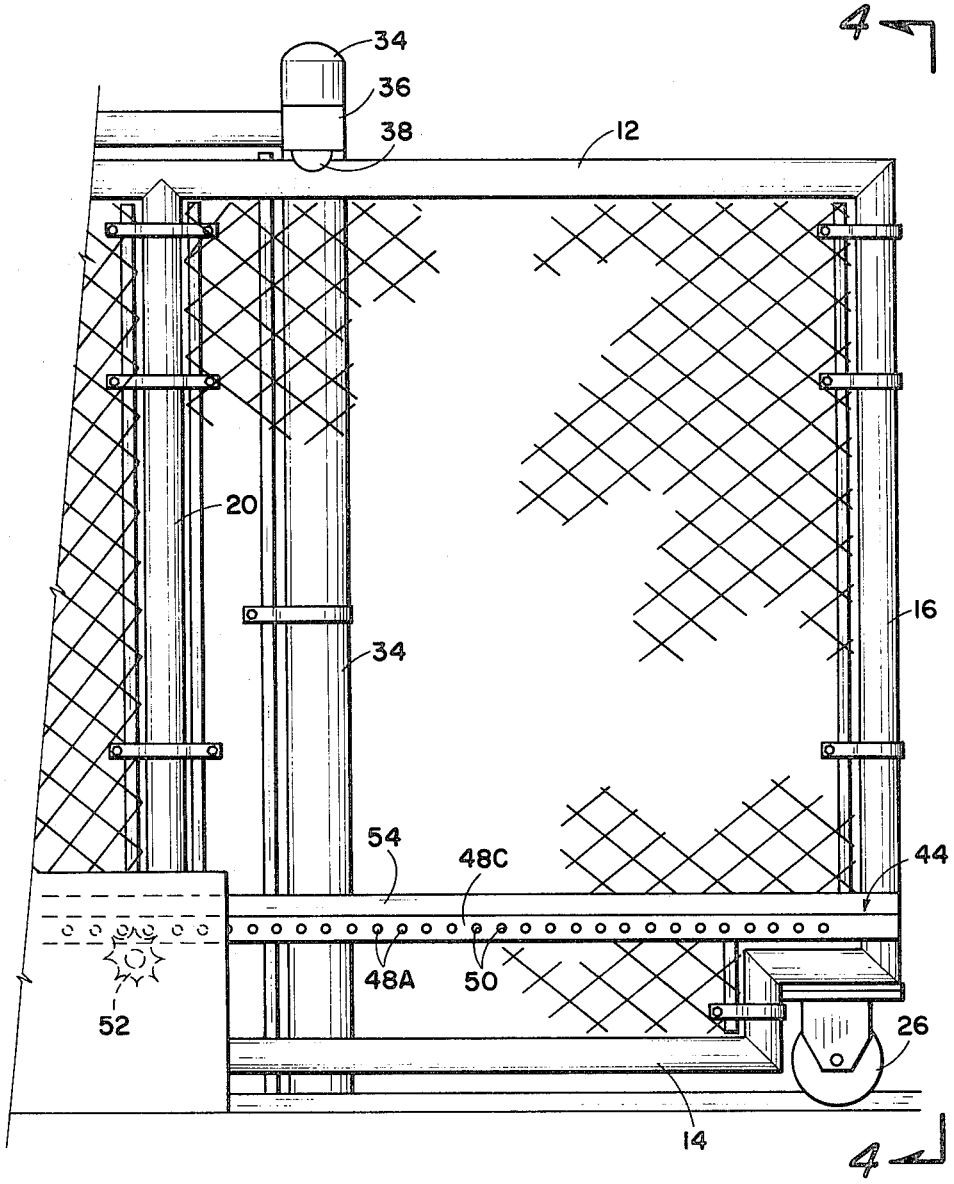
FIG. 3 is an enlarged elevational view of the forward end portion of the gate shown as the gate is near the opened position.

Referring to the drawings and first to FIGS. 1–4, an embodiment of the gate of this invention is illustrated. The gate is generally indicated by the numeral 10 and is in the form of a rectangular frame. The gate is illustrated as being of the woven wire type although obviously this is merely a matter of choice. The gate includes a top horizontal rail 12, a bottom rail 14, and vertical end rails 16 and 18. In addition, vertical spacers 20 and 22 extend between the bottom rail 14 and top rail 12, and the number of such spacers will depend upon the length of the gate. Woven wire 24 is stretched between the end rails and spacers in the usual form of constructing wire fences and gates.

Affixed to the bottom rail 14 are rollers 26 and 28. In order to permit the bottom rail 14 to be closer to the ground 30 or other surface on which the gate operates, the bottom rail 14 is provided at both ends with offsets to receive the base structure supporting the rollers 26 and 28.

The gate 10 is longitudinally moveable to close the space provided between posts 32 and 34. When the forward end rail 16 is adjacent post 32, the gate is closed; and to open the gate, it is moved in a vertical plane rearwardly so that the end rail 16 is adjacent post 34, thereby permitting free access through the opening formed between posts 32 and 34. To support the gate in a vertical plane the post 34 has a bracket 36 extending therefrom which rotatably supports a roller 38, the roller engaging the top rail 12.

Figure 4:
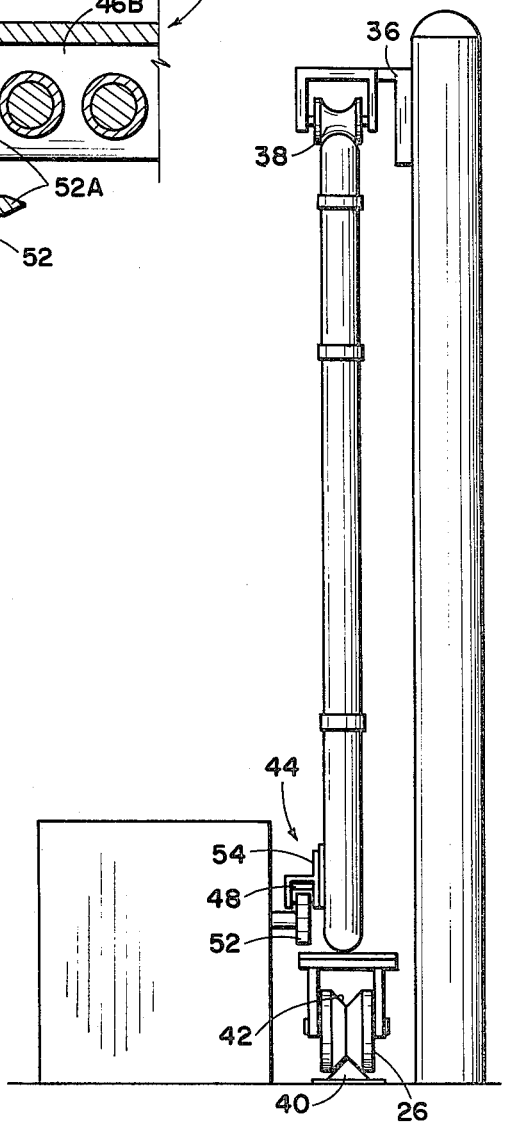
FIG. 4 is an end view of the gate as taken along the line 4—4 of FIG. 3.

Rollers 26 and 28 may be of the type which roll directly on surface 30 which may be such as a paved surface over which vehicles pass or, preferably, as illustrated, a track 40 is provided. As shown in FIG. 4, the track 40 may have a cross-sectional configuration in the form of an inverted V, and rollers 26 and 28 have a circumferential peripheral surface 42 which is recessed to conform to the cross-sectional shape of track 40. In this way the rollers 26 and 28 remain on the track 40 as the gate is moved between open and closed positions.

Figure 6:
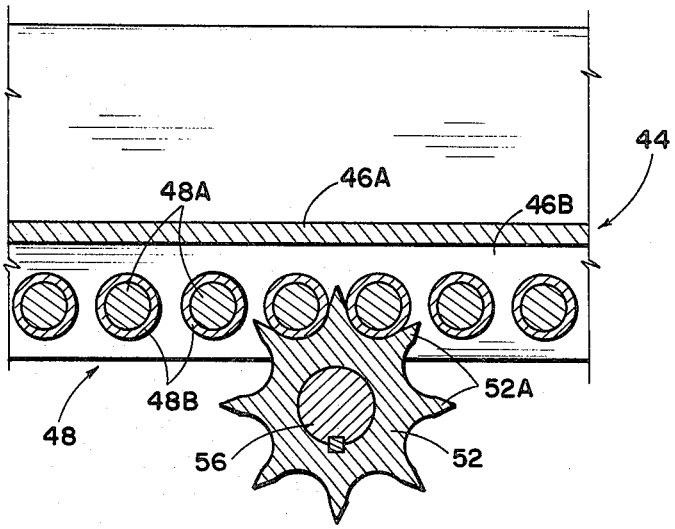
FIG. 6 is a cross-sectional view as taken along the line 6—6 of FIG. 5.
Figure 5:
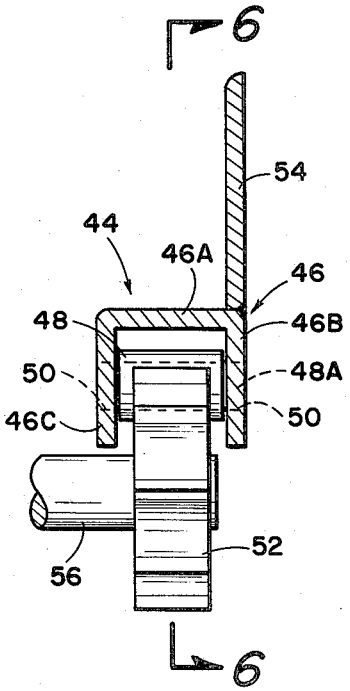
FIG. 5 is an enlarged fragmentary cross-sectional view taken along the line 5—5 of FIG. 1 showing the arrangement of the rack and the pinion gear.

The gate described up to this point is typical of gates which are employed for closing an opening in a fence. The present invention is directed toward improved means of electrically opening and closing the gate 10. For this purpose, there is affixed to one side of the gate, preferably spaced above the bottom rail 14, a rack 44. The rack is inverted, that is, the teeth or portions to be engaged by a pinion gear to be described subsequently, extend downwardly. A preferred construction of the rack 44 is illustrated in FIGS. 5 and 6. The rack includes an inverted channel formed of a horizontal web portion 46A and opposed downwardly extending integral parallel sides 46B and 46C. Thus the channel is of a standard structural type readily available. Positioned between the channel sides 46B and 46C are a plurality of pins 48. The pins 48 may be formed in a variety of ways, but in one method as illustrated, each of the pins 48 includes a central shaft portion 48A which may be formed of a circular bar. This may be secured to the channel side portions 46B and 46C by providing openings 50 in the channel sidewalls. The pin shaft portions 48A can then be inserted in aligned openings 50 and welded in position. Received about each of the shaft portions 48A is a tubular portion 48B. The tubular portions may be arranged to have an interior diameter slightly greater than the exterior diameter of the shaft portion 48A so that these portions rotate about the shaft portions. Thus each of the pins 48 are spaced apart from each other on parallel axii and provide a bearing arrangement for receiving a pinion gear 52.

Before describing the pinion gear and the method by which it is supported and rotated, it should be pointed out that the rack 44 formed of the inverted channel 46 can be further modified by including a plate portion 54 which is vertical and longitudinal, extending the full length of the inverted channel to add structural rigidity to the channel and the rack formed by it. The longitudinal plate 54 provides a means whereby the rack may easily be affixed to the gate end rails 16 and 18 and spacers 20 and 22.

Figure 7:
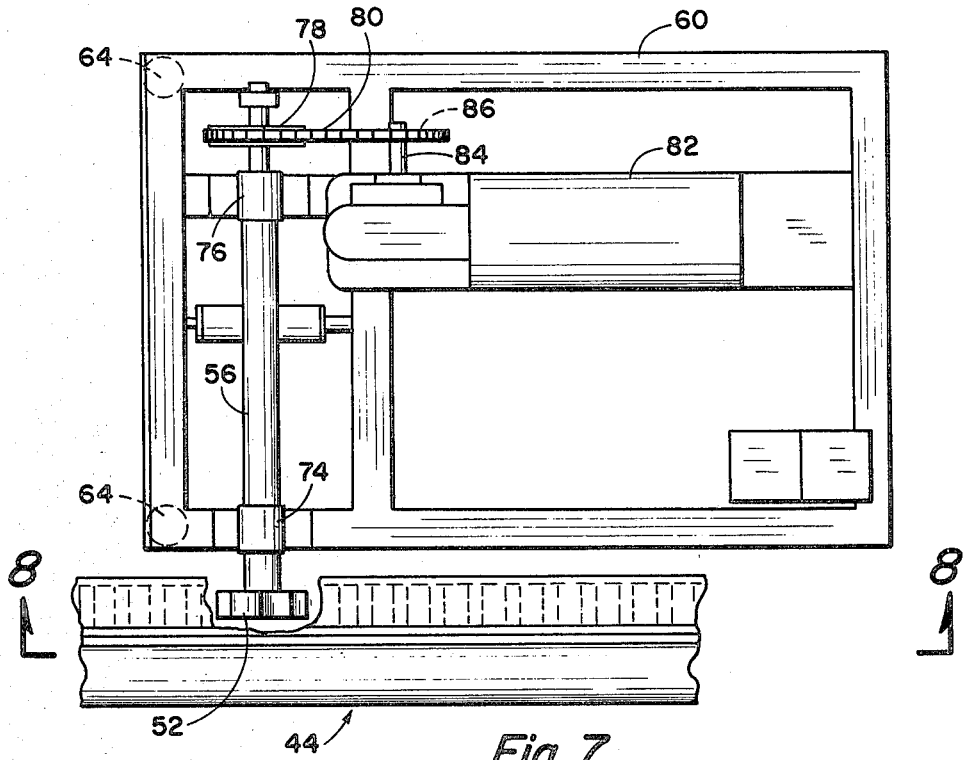
FIG. 7 is a top view, enlarged, of the drive means by which the gate is opened and closed taken along the line 7—7 of FIG. 1.
Figure 8:
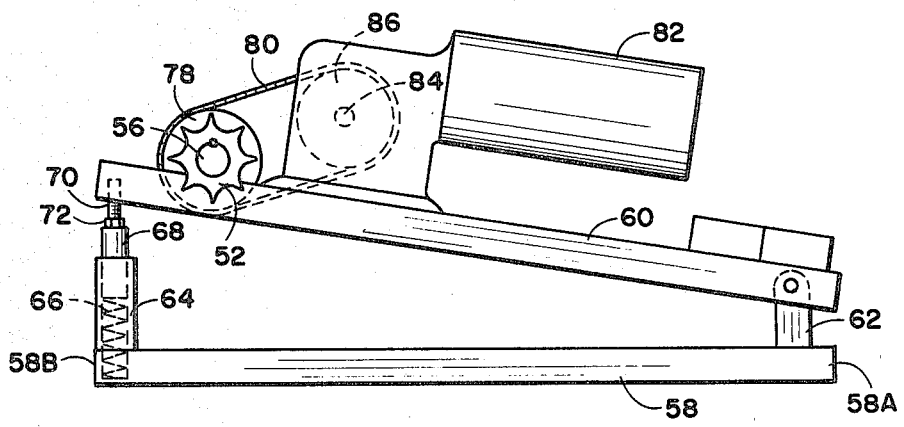
FIG. 8 is a side view of the drive means as taken along the line 8—8 of FIG. 7 but wherein the rack and the portion of the gate are not shown.

Pinion gear 52 has an exterior circumferential surface providing teeth 52A which engage the pins of the rack 44, the gear being affixed to and rotated by a shaft 56. An important part of this invention is the means whereby the pinion gear as supported by shaft 56 is resiliently urged upwardly into engagement with the pins of the rack 44 so that as the gate is moved longitudinally any elevational deviation will not prevent the operation of the gate. As previously indicated, the gate is particularly useful for providing access wherein vehicles pass through the gate. For such use it frequently happens that obstructions such as dirt, mud, gravel, etc. fall onto the area over which the rollers 26 and 28 roll as the gate is moved between the open and closed positions, and this occurs even when a track 40 is employed. These situations can cause the gate to be elevationally displaced; and if the pinion gear engaging the rack is at a fixed elevational position, disengagement between the rack and pinion gear can occur so that the gate can fail to operate, or damage can be caused by the improper meshing of the pinion gear and the rack. This invention provides means of circumventing these difficulties by utilization of an arrangement wherein the pinion gear is upwardly resiliently biased to at all times properly engage the rack regardless of any elevational change in the gate. Means whereby this is accomplished may best be understood by referring to FIGS. 7 and 8. The drive means includes a base 58 which can be mounted adjacent the gate on the surface 30. A support structure 60 is pivotally attached at one end to base 58. This is accomplished by means of an upstanding post 62 affixed at one edge of the base to which the support structure is pivotally attached. In order to provide means to resiliently upwardly bias the support structure 60, tubular members 64 are affixed to the base 58 adjacent the second end 58B thereof. Received in each of the tubular members 54 is a compression spring 66 and, above the spring, reciprocally received in each of the tubular members 64 is a plunger 68. The upper end of each of the plungers 68 has an axial recess therein which receives the lower end of a threaded bolt 70. The upper end of each of the bolts 70 is pivotally affixed to the support structure 60. By means of a nut 72, more or less of each of the bolts 70 is received within plunger 68. Thus by means of nuts 72 the amount of upward bias provided by springs 66 is adjustable.

Mounted on support structure 60 by means of pillow block bearings 74 and 76 is the pinion gear shaft 56. The end of the shaft 56 opposite that supporting pinion gear 52 has a drive gear 78 which, in the form illustrated, is a sprocket receiving chain 80. Mounted on the support structure 60 is an electric gear motor 82 having an output shaft 84. Affixed on shaft 84 is a gear 86 which receives the chain 80 thereon. Thus the drive motor 82 rotates the shaft 56 and thereby pinion gear 52; and when the motor is energized, the pinion gear moves the rack 44 horizontally to displace the gate. Any variations in the elevational position of the gate and thereby the rack is compensated for by the hinged arrangement of the support structure 60 as springs 66 urge the support structure and thereby pinion gear 52 upwardly at all times.

All of the elements of the gate and operating mechanism of this invention are readily commercially available. The gear drive motor 82 and gears 78, 86, and the pinion gear 52 are all readily available without having to be specially manufactured. The rack 44 is easily manufactured by the techniques described herein. All of the elements of the gate are the standard parts used in fencing. Thus the invention provides a unique electrically operated gate which can be manufactured of available components enabling the device to be economically and efficiently constructed and repaired as necessary.

The electrical circuitry for operating the gear motor 82 is not described since it is standard and well known. Limit switches as necessary can be employed to stop the gate when it is in the fully open or fully closed position, and the gear motor can be actuated by remote control means, all of which are well known.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. An improved electrically operated gate comprising:

a rectangular frame having a top horizontal rail, a bottom horizontal rail, and vertical ends;

a roller adjacent each end extending below said bottom rail by which the gate rolls from an open to a closed position and vice versa, the gate moving in a longitudinal vertical plane;

means engaging said top rail to maintain said frame in a vertical plane;

an inverted horizontal rack affixed to said frame on one side thereof, the rack providing a series of equally spaced teeth;

an electric motor drive means affixed at a stationary position adjacent the gate frame and having a pinion drive gear rotatably extending therefrom, the pinion drive gear being below said rack and in engagement with the rack teeth; and means of resiliently urging said pinion gear upwardly into engagement with said rack teeth whereby when said electric motor drive means is energized said gate frame is longitudinally moved to open or close the gate depending on the direction of rotation of the pinion gear.

2. An improved electrically operated gate according to claim 1 wherein each of said rollers has a recessed peripheral surface and including:

a horizontal track positioned to receive said rollers and guide said gate frame as the gate is moved from the opened to the closed position and vice versa, and in which the cross-sectional contour of the track conforms to and is received by the recessed peripheral surface of said rollers.

3. An improved electrically operated gate according to claim 1 wherein said rack teeth are in the form of cylindrical pins, the axii of the pins being parallel each other and perpendicular the longitudinal axis of the rack.

4. An improved electrically operated gate according to claim 3 wherein said rack is in the form of an inverted channel member defined in cross-section by a horizontal center web and opposed downwardly extending paralleled sides, said pins being affixed between the inside surfaces of the sides.

5. An improved electrically operated gate according to claim 1 wherein said electric motor drive means includes:

a base for supporting in a stationary position adjacent said gate frame;

a support structure pivotally affixed at a first end to said base;

spring means extending between said base and the second end of said support structure whereby said support structure second end is urged resiliently upwardly; and means of rotatably supporting said electric motor drive means and pinion gear to said support structure whereby said pinion gear is resiliently urged upwardly to engage said rack.

6. An improved electrically operated gate according to claim 5 wherein said spring means includes a plurality of upwardly extending tubular members supported at their lower ends to said base;

a spring received in each said tubular member;

a plunger reciprocally received in each said tubular member in engagement with the spring therein, the upper end of each plunger being affixed to said support structure adjacent the second end.

7. An improved electrically operated gate according to claim 5 wherein the length of each of said plungers is adjustably variable whereby the force by which said pinion gear is resilient urged against said rack may be varied.

8. An improved electrically operated gate according to claim 5 wherein said means of rotatably supporting said electric motor drive means and pinion gear to said support structure includes:

a shaft rotatably supported to said support structure, said pinion gear being affixed to one end of the shaft;

an electric motor means having an output shaft, the motor means being affixed to said support structure;

and gear means coupling said motor shaft to said drive shaft.

* * * * *